US008116931B2

(12) United States Patent
Hamama et al.

(10) Patent No.: US 8,116,931 B2
(45) Date of Patent: Feb. 14, 2012

(54) FAST FUEL ADJUSTMENT SYSTEM DIAGNOSTIC SYSTEMS AND METHODS

(75) Inventors: Wajdi B. Hamama, Whitmore Lake, MI (US); Richard D Wells, Katy, TX (US)

(73) Assignee: GM Global Technology Operations LLC

( * ) Notice: Subject to any disclaimer, the term of this patent is extended or adjusted under 35 U.S.C. 154(b) by 1309 days.

(21) Appl. No.: 11/803,680

(22) Filed: May 15, 2007

(65) Prior Publication Data

US 2008/0288133 A1 Nov. 20, 2008

(51) Int. Cl.
*F02D 41/14* (2006.01)

(52) U.S. Cl. ..... 701/29; 123/673

(58) Field of Classification Search ..... 701/29, 701/103; 123/673, 674, 676, 703, 480; 60/276
See application file for complete search history.

(56) References Cited

U.S. PATENT DOCUMENTS 5,642,705 A * 7/1997 Morikawa et al. ..... 123/300
5,845,491 A * 12/1998 Yasui et al. ..... 60/276
6,082,345 A * 7/2000 Ikeuchi et al. ..... 123/689
6,161,531 A * 12/2000 Hamburg et al. ..... 123/674

* cited by examiner

*Primary Examiner* — Dalena Tran

(57) ABSTRACT

A control system for diagnosing a fuel system of a vehicle is provided. The system generally includes a correction term module that estimates a fuel correction term based on a first fuel correction value and a second fuel correction value, wherein the first fuel correction value is based on a first period and the second fuel correction value is based on a second period, and wherein the first period is longer than the second period. A diagnostic module diagnoses the fuel system of the vehicle based on the fuel correction term.

18 Claims, 3 Drawing Sheets

FAST FUEL ADJUSTMENT SYSTEM DIAGNOSTIC SYSTEMS AND METHODS

FIELD

The present disclosure relates to methods and systems for diagnosing a fuel system of a vehicle.

BACKGROUND

The statements in this section merely provide background information related to the present disclosure and may not constitute prior art.

Internal combustion engines combust an air/fuel (A/F) mixture within cylinders to drive pistons and to provide drive torque. Air is delivered to the cylinders via a throttle and an intake manifold. A fuel injection system supplies fuel from a fuel tank to provide fuel to the cylinders based on a desired A/F mixture. To prevent release of fuel vapor, a vehicle may include an evaporative emissions system which includes a canister that absorbs fuel vapor from the fuel tank, a canister vent valve, and a purge valve. The canister vent valve allows air to flow into the canister. The purge valve supplies a combination of air and vaporized fuel from the canister to the intake system.

A fuel diagnostic system monitors the fuel delivery to the engine. A fuel correction value can be estimated based on a measured air/fuel ratio and a commanded air/fuel ratio. If the estimated fuel correction value is outside of certain predetermined thresholds, a diagnostic trouble code can be recorded. Multiples instances of the estimated correction value being outside of the certain predetermined thresholds can cause a Service Engine Soon light to illuminate. Thus, properly diagnosing the fuel delivery can affect warranty.

In addition, to diagnose the fuel delivery, the purge valve is temporarily controlled such that the air and vaporized fuel is prevented from entering the intake system. Such intrusive interruption to the fueling system can affect fuel economy and/or emissions if the interruptions are frequent and/or are for long periods of time.

SUMMARY

Accordingly, a control system for diagnosing a fuel system of a vehicle is provided. The system generally includes a correction term module that estimates a fuel correction term based on a first fuel correction value and a second fuel correction value, wherein the first fuel correction value is based on a first period and the second fuel correction value is based on a second period, and wherein the first period is longer than the second period. A diagnostic module diagnoses the fuel system of the vehicle based on the fuel correction term.

In other features, a method of diagnosing a fuel system of a vehicle is provided. The method includes: estimating a fuel correction term based on a first fuel correction value and a second fuel correction value, wherein the first fuel correction value is based on a first period and the second fuel correction value is based on a second period, and wherein the first period is longer than the second period; monitoring the fuel correction term for change based on a stability threshold; and diagnosing the fuel system of the vehicle based on the monitoring of the fuel correction term.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
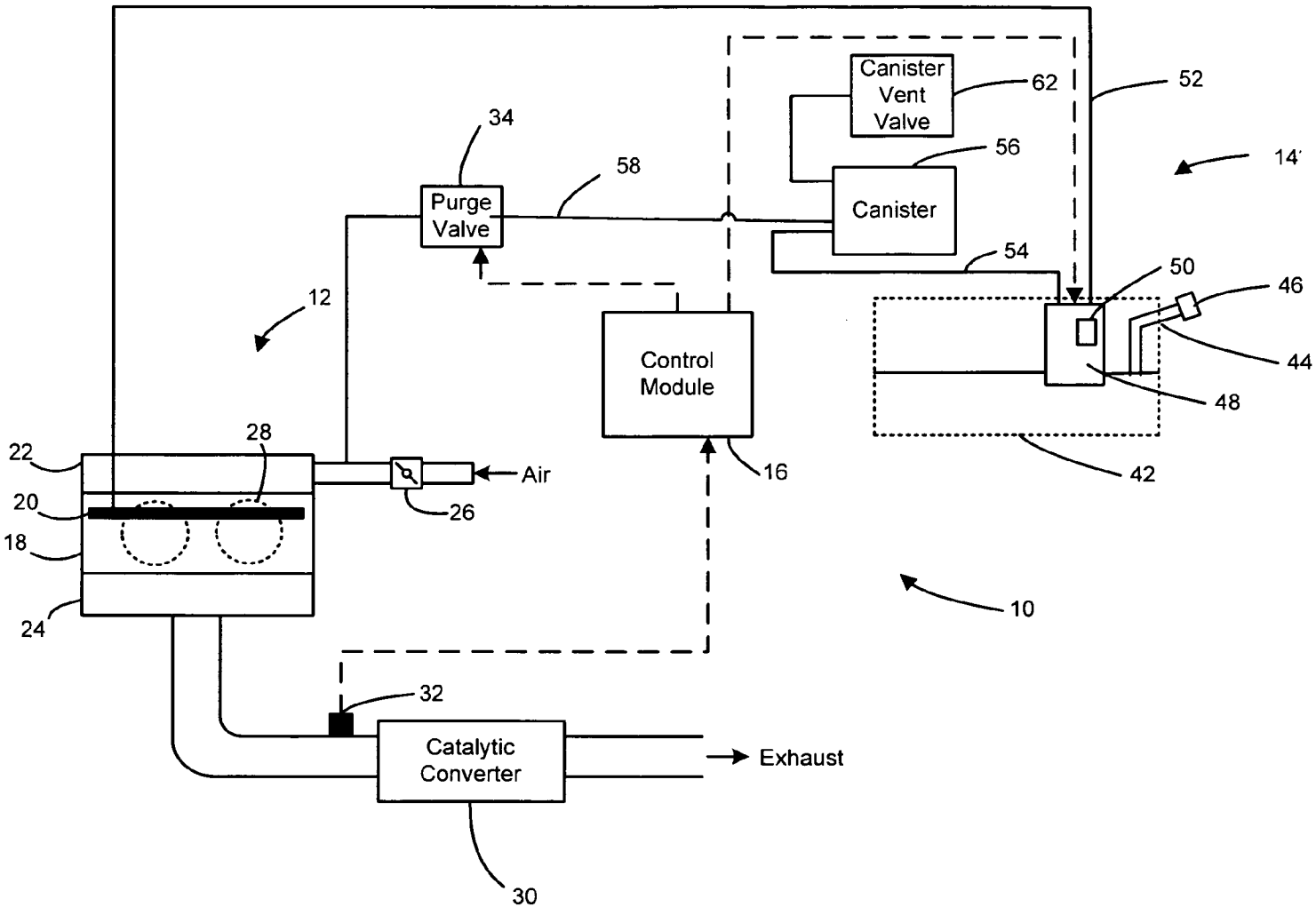
FIG. 1 is a functional block diagram illustrating an exemplary vehicle including a fast fuel adjustment diagnostic system according to various aspects of the present disclosure.

The following description is merely exemplary in nature and is not intended to limit the present disclosure, application, or uses. It should be understood that throughout the drawings, corresponding reference numerals indicate like or corresponding parts and features. As used herein, the term module refers to an application specific integrated circuit (ASIC), an electronic circuit, a processor (shared, dedicated, or group) and memory that executes one or more software or firmware programs, a combinational logic circuit, and/or other suitable components that provide the described functionality.

Referring to FIG. 1, a vehicle 10 includes an engine system 12 and a fuel system 14. One or more control modules 16 communicate with the engine and fuel systems 12, 14. The fuel system 14 selectively supplies liquid and/or fuel vapor to the engine system 12, as will be described in further detail below.

The engine system 12 includes an engine 18, a fuel injection system 20, an intake manifold 22, and an exhaust manifold 24. Air is drawn into the intake manifold 22 through a throttle 26. The throttle 26 regulates mass air flow into the intake manifold 22. Air within the intake manifold 22 is distributed into cylinders 28. The air is mixed with fuel and the air/fuel (A/F) mixture is combusted within cylinders 28 of the engine 18. Although two cylinders 28 are illustrated, it can be appreciated that the engine 18 can include any number of cylinders 28 including, but not limited to 1, 3, 4, 5, 6, 8, 10 and 12 cylinders. The fuel injection system 20 includes liquid injectors that inject liquid fuel into the cylinders 28. Exhaust from the combustion flows through the exhaust manifold 24 and is treated in a catalytic converter 30. An exhaust oxygen sensor 32 (e.g., a wide-range A/F ratio sensor) senses a level of oxygen in the exhaust and communicates an exhaust A/F ratio signal to the control module 16.

The fuel system 14 includes a fuel tank 42 that contains liquid fuel and fuel vapor. A fuel inlet 44 extends from the fuel tank 42 to enable fuel filling. A fuel cap 46 closes the fuel inlet 44 and may include a bleed hole (not shown). A modular reservoir assembly (MRA) 48 is disposed within the fuel tank 42 and includes a fuel pump 50. The MRA 48 includes a liquid fuel line 52. The fuel pump 50 pumps liquid fuel through the liquid fuel line 52 to the fuel injection system 20 of the engine 18.

In various embodiments, the fuel system 14 can include a fuel vapor system. The fuel vapor system includes a fuel vapor line 54 and a canister 56. Fuel vapor flows through the fuel vapor line 54 into the canister 56. A fuel vapor line 58 connects a purge valve 34 to the canister 56. The control module 16 modulates the purge valve 34 to selectively enable fuel vapor to flow into the intake system of the engine 18. The control module 16 modulates a canister vent valve 62 to selectively enable air to flow from the atmosphere into the canister 56.

The control module 16 controls the fuel and air provided to the engine 18 based on signals from the oxygen sensor 32 and a position of the throttle valve 26. This form of fuel control is also referred to as closed loop fuel control. Closed loop fuel control is used to maintain the A/F mixture at or close to a stoichiometric A/F ratio by commanding a desired fuel delivery to match the airflow. Stoichiometry is defined as an ideal A/F ratio (e.g., 14.7 to 1 for gasoline).

The control module 16 estimates a fuel control correction term that helps maintain the A/F ratio within an ideal range (i.e., above a minimum value and below a maximum value) of the stoichiometric A/F ratio. An exemplary fuel control correction term includes a short term correction (STC) that provides a rapid indication of fuel correction based on the input signal from the oxygen sensor 32. For example, if the signal indicates an A/F ratio greater than a specified reference, the STC is increased a step. Conversely, if the signal indicates an A/F ratio less than the specified reference, the STC is decreased a step. A long term correction (LTC) indicates changes in the fuel control factor over a long term. For example, the LTC monitors STC and uses integration to produce an output.

According to the fast fuel diagnostic methods and systems of the present disclosure, the control module 16 monitors a combination of the long term correction and the short term correction to enable and disable the diagnosing of the fuel system 14. The combination correction provides for a faster response, thus, allowing the control module 16 to diagnose the fuel system 14 faster and less often and thus, improving the number of intrusive interruptions to the fuel system 14.

Figure 2:
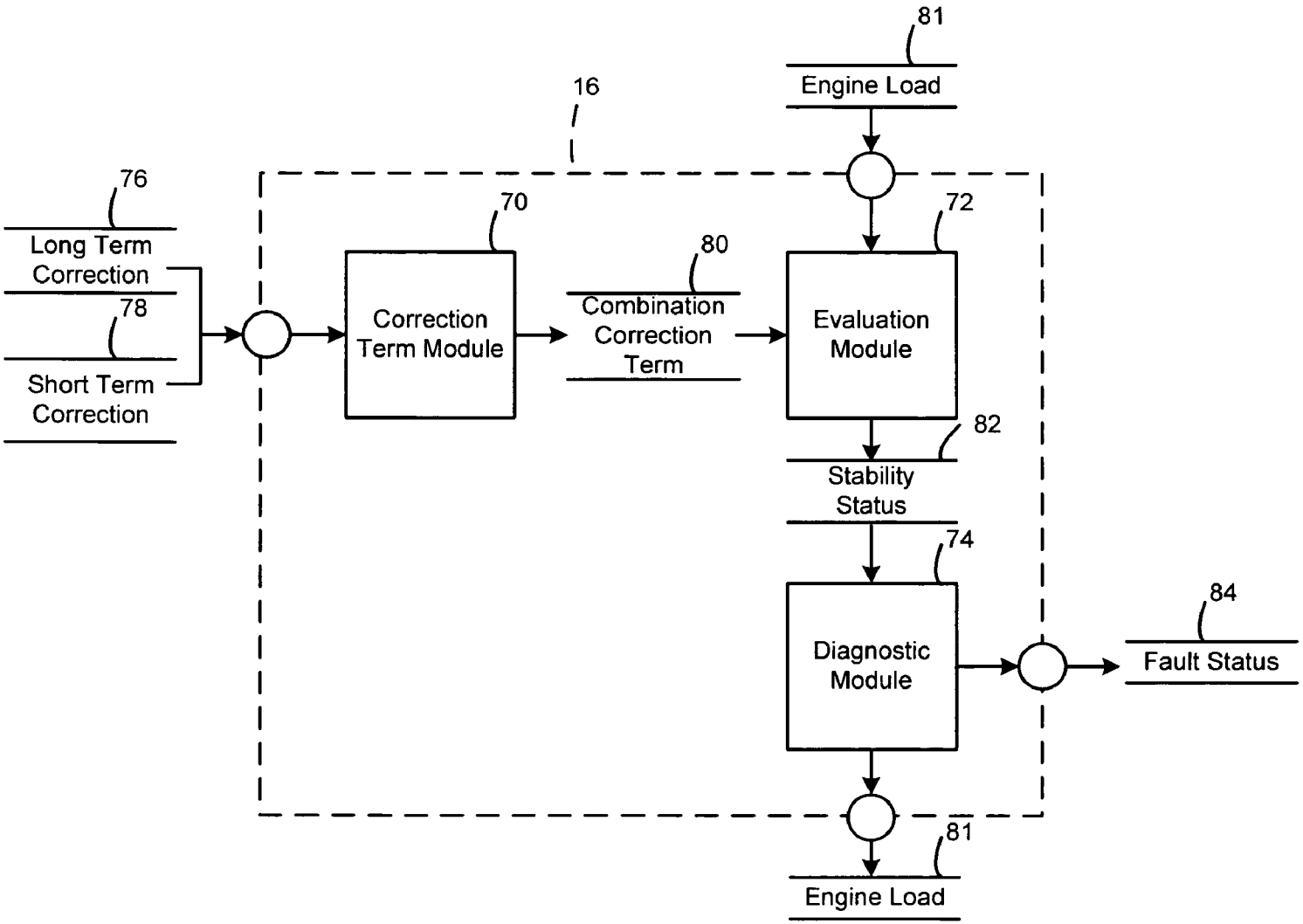
FIG. 2 is a dataflow diagram illustrating an exemplary fast fuel adjustment diagnostic system according to various aspects of the present disclosure.

Referring now to FIG. 2, a dataflow diagram illustrates various embodiments of a fast fuel adjustment diagnostic system that may be embedded within the control module 16. Various embodiments of fast fuel adjustment diagnostic systems according to the present disclosure may include any number of sub-modules embedded within the control module 16. As can be appreciated, the sub-modules shown may be combined and/or further partitioned to similarly diagnose the fuel system 14. Inputs to the fast fuel adjustment diagnostic system may be sensed from the vehicle 10 (FIG. 1), received from other control modules (not shown) within the vehicle 10 (FIG. 1), and/or determined by other sub-modules (not shown) within the control module 16. In various embodiments, the control module 16 of FIG. 2 includes a correction term module 70, a stabilization evaluation module 72, and a diagnostic module 74.

The correction term module 70 receives as input a long term correction 76 and a short term correction 78 that can be determined as discussed above. The correction term module 70 combines the long term correction 76 and the short term correction 78 to form a combination correction term 80. In particular, the correction term module 70 computes a summation of the long term correction 76 and the short term correction 78 and subtracts a predetermined constant (e.g., one) from the summation to form the combination correction term 80. In various embodiments, the correction term module 70 applies a filter to the combination correction term 80. Such filter may include, but is not limited to, an exponentially weighted moving average filter.

The stabilization evaluation module 72 receives as input the combination correction term 80. The stabilization evaluation module 72 then monitors the combination correction term 80 for stability or minimal change (i.e., a change less than a stability threshold). In various embodiments, the stabilization evaluation module 72 can compare the current combination term to a previous combination term for a given engine load. Once the combination correction term 80 is stable, the stabilization evaluation module 72 sets a stability status 82 to indicate stability (i.e., stability status=TRUE). Otherwise, the stabilization evaluation module 72 sets the stability status 82 to indicate instability (i.e., stability status=FALSE).

The diagnostic module 74 receives as input the stability status 82. Based on the stability status 82, the diagnostic module 74 enables the diagnosing of the fuel system 14 (FIG. 1). In various aspects, once the stability status 82 indicates stability, the diagnostic module 74 diagnoses the fuel system 14 (FIG. 1) by comparing the commanded fuel to a desired fuel. Such desired fuel can be determined based on open loop fueling values for particular engine load conditions 81. Based on the diagnosing, the diagnostic module 74 sets a fault status 84 that indicates whether or not a fault in the fuel system 14 (FIG. 1) exists.

As can be appreciated, once the fault status 84 is set to indicate a fault in the fuel system 14 (FIG. 1), additional steps can be performed to notify other systems and users of the failure. In various embodiments, a diagnostic code is set based on the fault status 84. The diagnostic code can be retrieved by a service tool or transmitted to a remote location via a telematics system. In various other embodiments, an indicator lamp is illuminated based on the fault status 84. In various other embodiments, an audio warning signal is generated based on the fault status 84.

Figure 3:
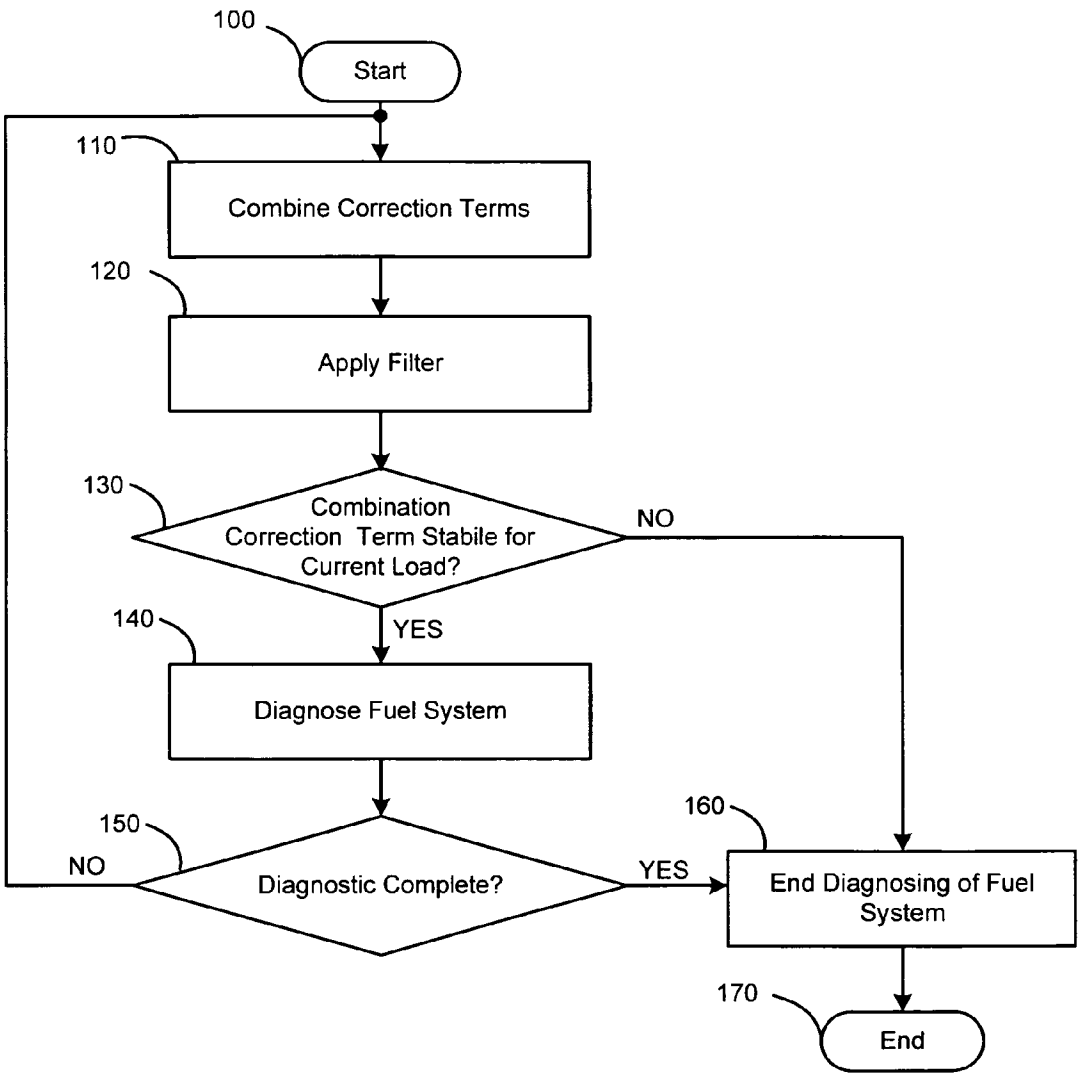
FIG. 3 is a flowchart illustrating an exemplary fast fuel adjustment diagnostic method that can be performed by the fast fuel adjustment diagnostic system according to various aspects of the present disclosure.

Referring now to FIG. 3, a flowchart illustrates an exemplary fast fuel adjustment diagnostic method that can be performed by the fast fuel adjustment diagnostic system of FIG. 2 in accordance with various aspects of the present disclosure. As can be appreciated, the order of execution of the steps of the exemplary fast fuel adjustment diagnostic method can vary without altering the spirit of the method. The exemplary method may be performed periodically during control module operation or be scheduled to run based on certain events.

In one example, the method may begin at 100. The combination correction term 80 is computed at 110. In various aspects, the combination correction term 80 is computed based on the following equation:

$$CCT=LTC+STC-1 \quad (1)$$

Where CCT represents the combination correction term 80, LTC represents the long term correction 76, and STC represents the short term correction 78. In various aspects, a filter is applied to the combination correction term 80 at 120. The filtered combination correction term 80 is then evaluated at 130. If the combination correction term 80 for a given engine load is stable at 130, the fuel system 14 (FIG. 1) is diagnosed at 140. The diagnosing continues at 140 while the combination correction term is stable at 130 and until the diagnostic is complete at 150. If the combination correction term 80 for a given engine load becomes or remains unstable at 130 or the diagnostic completes at 150, the diagnostic functions end at 160 thereby terminating any intrusive interruptions to the fuel system 14 (FIG. 1) and the method may end at 170.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, specification, and the following claims.

What is claimed is:

1. A control system for diagnosing a fuel system of a vehicle, comprising:

a correction term module that estimates a fuel correction term based on a first fuel correction value and a second fuel correction value, wherein the first fuel correction value is based on a first period and the second fuel correction value is based on a second period, and wherein the first period is longer than the second period; and a diagnostic module that diagnoses the fuel system of the vehicle based on the fuel correction term.

2. The system of claim 1 wherein the correction term module estimates the fuel correction term by computing a summation of the first fuel correction value and the second fuel correction value.

3. The system of claim 2 wherein the correction term module estimates the fuel correction term by subtracting a constant from the summation of the first fuel correction value and the second fuel correction value.

4. The system of claim 1 further comprising a stability evaluation module that monitors the fuel correction term for a change in the fuel correction term to be less than a stability threshold and wherein the diagnostic module diagnoses the fuel system when the change is less than the stability threshold.

5. The system of claim 4 wherein the correction term module applies a filter to the fuel correction term, and wherein the stability evaluation module monitors the filtered fuel correction term for the change.

6. The system of claim 4 wherein the stability evaluation module monitors the fuel correction term for the change by comparing a current fuel correction term with a previous fuel correction term.

7. The system of claim 4 wherein the stability evaluation module monitors the fuel correction term for the change based on an engine load.

8. The system of claim 1 wherein the diagnostic module diagnoses the fuel system of the vehicle based on a commanded fuel and a desired fuel.

9. The system of claim 1 wherein the diagnostic module diagnoses the fuel system of the vehicle based on engine load.

10. A method of diagnosing a fuel system of a vehicle, comprising:

estimating a fuel correction term, using a correction term module, based on a first fuel correction value and a second fuel correction value, wherein the first fuel correction value is based on a first period and the second fuel correction value is based on a second period, and wherein the first period is longer than the second period;

monitoring the fuel correction term, using a diagnostic module, for change based on a stability threshold; and diagnosing the fuel system of the vehicle, using the diagnostic module, based on the fuel correction term.

11. The method of claim 10 wherein the estimating further comprises computing the fuel correction term by computing a summation of the first fuel correction value and the second fuel correction value.

12. The method of claim 11 wherein the estimating further comprises computing the fuel correction term by subtracting a constant from the summation of the first fuel correction value and the second fuel correction value.

13. The method of claim 10 further comprising applying a filter to the fuel correction term and wherein the monitoring comprises monitoring the filtered fuel correction term for the change.

14. The method of claim 10 wherein the monitoring the fuel correction term for the change comprises monitoring the fuel correction term by comparing a current fuel correction term with a previous fuel correction term.

15. The method of claim 10 wherein the monitoring the fuel correction term for the change comprises monitoring the fuel correction term based on engine load.

16. The method of claim 10 wherein the diagnosing comprises diagnosing the fuel system once the change of the fuel correction term is less than the stability threshold.

17. The method of claim 10 wherein the diagnosing comprises diagnosing the fuel system of the vehicle based on a commanded fuel and a desired fuel.

18. The method of claim 10 wherein the diagnosing comprises diagnosing the fuel system of the vehicle based on engine load.

* * * * *